United States Patent [19]

Andre

[11] 4,412,687

[45] * Nov. 1, 1983

[54] SKI

[75] Inventor: Wieme Andre, Zwevegem, Belgium

[73] Assignee: N.V. Bekaert S.A., Zwevegem, Belgium

[ * ] Notice: The portion of the term of this patent subsequent to Jul. 14, 1998, has been disclaimed.

[21] Appl. No.: 347,788

[22] Filed: Feb. 11, 1982

Related U.S. Application Data

[63] Continuation of Ser. No. 80,050, Sep. 28, 1979, abandoned.

[30] Foreign Application Priority Data

Sep. 28, 1978 [NL] Netherlands ..... 7809832
Jan. 31, 1979 [LU] Luxembourg ..... 80858

[51] Int. Cl.[3] ..... A63C 5/00
[52] U.S. Cl. ..... 280/610; 428/229
[58] Field of Search ..... 280/601, 610, 609; 428/229, 295

[56] References Cited

U.S. PATENT DOCUMENTS

| | | | |
|---|---|---|---|
| 3,698,731 | 10/1972 | Jost et al. | 280/610 |
| 3,844,576 | 10/1974 | Schultes | 280/610 |
| 3,893,681 | 7/1975 | Manning et al. | 280/610 |
| 3,902,732 | 9/1975 | Fosha, Jr. et al. | 280/610 |
| 4,065,150 | 12/1977 | Van Auken | 280/610 |
| 4,071,264 | 1/1978 | Legrand et al. | 280/610 |
| 4,278,726 | 7/1981 | Wieme | 428/229 |

FOREIGN PATENT DOCUMENTS 1703859 4/1972 Fed. Rep. of Germany .

*Primary Examiner*—Joseph F. Peters, Jr.
*Assistant Examiner*—Michael Mar
*Attorney, Agent, or Firm*—Edward J. Brenner

[57] ABSTRACT

A ski of laminated material which comprises at least one core layer of rigid material wherein at least a portion of at least one of its plane sides is covered with a rubber-like material having a loss tangent of about 0.1 and in which material twisted filament bundles are embedded, the filaments having a tensile strength of at least 2000 $N/mm^2$ and a modulus of elasticity of at least $7\times10^4$ $N/mm^2$.

10 Claims, 2 Drawing Figures

SKI

This application is a continuation of application Ser. No. 80,050, filed Sept. 28, 1979 now abandoned.

The invention relates to a ski and specifically to a ski made of laminated material.

Skis are presently often made of synthetic material, and more particularly in so-called sandwich construction whereby a low density core layer is encased by glass-fibre-reinforced resin layers. The core layer may possibly consist of juxtaposed tubular elements. It is also known to make snow-skis by having a foam plastic core layer encased at both sides by rubber layers. It is known from U.S. Pat. No. 3,698,731, to use materials with energy absorbing properties in laminate snow-skis in order to damp the vibrations of the ski ends. Indeed, when the ski tips or tails start to vibrate or flutter, or, even worse, when they come in resonance when sliding over irregularities in the ski piste, the stability and the guiding capacity of the ski drop considerably, which may be disadvantageous and even dangerous.

According to the invention these damping requirements are effectively satisfied with a simple laminate buildup of the ski, whereby also the breaking strength can be considerably raised. It is sufficient to cover a core layer or supporting layer of rigid but not brittle material (and coated with, or enveloped in epoxy-resin-impregnated glass fibre layers as in currently used skis) over at least a portion of at least one of its plane sides (upperside/underside), with rubber or rubberlike material in which fibres are embedded. The rubberlike material contains thermoplastic (flexible) resin and/or an elastomer. A vulcanizable elastomer is very suitable. The rubberlike material offers a better vibration damping of the ski at free vibration. This damping is partly attributable to the self-damping capacity of the rubberlike material and partly to the friction and deformation of the fibres embedded in this layer. Under dynamic loading conditions, the visco-elastic behaviour of the ski is improved: apart from elastic behaviour, as characterized by a modulus of elasticity E' increased by the introduction of fibres in the rubberlike layer, the damping capacity is determined by a loss modulus E''. The rubberlike layer will preferably possess good flexibility and self-damping capacity throughout a wide temperature range (−40° C. to +60° C.), as well as good adhesion capacities to the embedded fibres.

The embedment of fibres with high-tensile strengths (tensile strength >2000 N/mm2) and high E moduli (>$7.10^4$ N/mm2) also increases the strength and rigidity of the ski. Eligible materials for the fibres are glass, carbon, boron, polyamide, polyaramide, polyester and/or metal fibres or wires. Fibres of different materials can be used. The fibres can be introduced in out or endless fashion, either separately or bundled, for example in the form of yarns, cables, cords. Moreover, the fibres can be processed into the rubberlike layer in woven, braided and non-woven relationship. The fibre material will preferably predominately extend in the longitudinal direction of the ski, particularly when the latter is to possess a high tensile strength and high E modulus. This offers two advantages at the same time: on the one hand, an increase in damping capacity, and, on the other, an increased ski rigidity. Steel cords are particularly suitable for embedment in the rubberlike material. The steel cord construction in the upper layer may differ from that in the under layer. The supporting layer of the ski will preferably possess a density between 45 g/dm3 and 1000 g/dm3 and may therefore consist of: balsa-wood, thermoplastic foam materials (for example ABS foam), polyurethane foam, polymethacrylimide foam or honeycomb structures (for example made of aluminium strips). If desired, the foam material core may be fibre-reinforced.

Furthermore, it has appeared advantageous to provide a specific anchoring layer between the glass fibre/epoxy resin layer (which now encase the light core layer) and the rubberlike layer (layers) when the adhesion between both is only moderate (for example in case of ordinary rubber). This intermediate layer may improve, apart from the adhesion, also the mechanical anchoring between the epoxy glass/fibre layer and the rubberlike layer. For that purpose, it may for example contain a glass fiber fabric of which one plane side is partly embedded in the rubberlike layer, whereas the other side is embedded in the viscous-epoxy layer, which process takes place during the fabrication of the ski.

In an embodiment of the ski which deserves special preference, the rigid material layer is encased by the rubberlike material containing the embedded fibres. The fibres must extend over at least a part of the plane sides of the ski. The invention also covers the further described method for the manufacture of the encased ski core in a mould.

The ski according to the invention will now be further clarified whereby reference is made to the adjoined figures.

Figure 1:
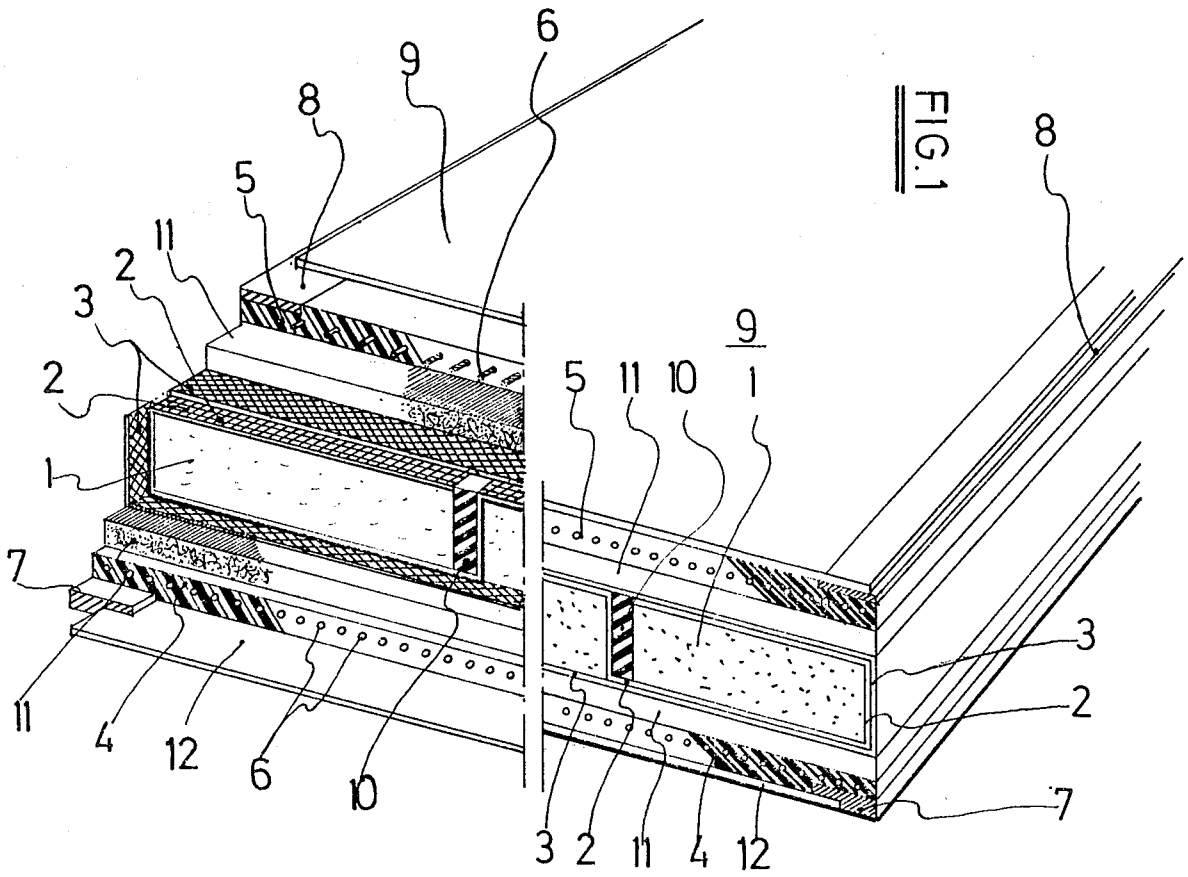
FIG. 1 is a cross-sectional view of a ski buildup which is covered at both sides with rubberlike material.

For the buildup of the ski according to FIG. 1, two oil-hardened steel strips 7 are placed in a mould, whereafter, as a rubberlike layer 4, a 1.2 mm thick unvulcanized rubber sheet is applied on said strips, in which sheet by extrusion per cm width of the sheet, 3.5 brass coated steel cords 6, construction 5×0.25 (five 0.25 dia. torsioned wires), with an elongation at rupture of about 1.5%, are embedded. A glass fibre fabric (not shown) is applied on the rubber sheet (300 g/$m^2$), as an anchoring layer, and joined to it under normal vulcanization pressure and temperature in order to bond the steel strips and the glass fabric firmly to the rubber layer.

In an analogous way, an identical steel-cord-reinforced rubber strip 5 is placed in a second mould on two aluminium strips 8 (acting as top edge protectors in the ski) and afterwards covered with a glass fabric as anchoring layer and vulcanized for consolidation.

The first laminate (4.7) is now placed at the bottom of the final ski mould, and on the upperside of the glass fabric-anchoring layer, four layers of undirectional epoxy-impregnated glass filament bundles 11 are provided in the longitudinal direction of the ski. Thereon, the core layer is built up, consisting of three juxtaposed balsa-wood strips 1 between which upright prehardened walls 10 of glass fibre/epoxy resin composites are provided. Between and around the strips 1, an epoxy resin/impregnated glass fabric 2 is wrapped of which the warp extends in the longitudinal direction of the ski. Around this core an analogous impregnated glass fabric 3 is wrapped, but so that warp and weft form an angle of approximately 45° to the longitudinal ski axis. In this way the core layer construction possesses adequate torsion rsistance.

Subsequently, the core layer is covered again with some six axial layers of epoxy-impregnated glass filament bundles 11. These axial glass fibre layers 11 under and above the core layer mainly serve to increase the rigidity and bending strength in the longitudinal direction of the ski.

Finally, the rubberlike layer 5, which has been preliminarily vulcanized and provided with top edges 8 and a glass fibre anchoring fabric, is placed on the core layer. The mould is then closed and its contents are hardened at the appropriate temperature for a few hours.

Afterwards, after removing the ski from the mould, a runner 12, for example made of polyethylene, and a thermo-plastic (for example ABS) finishing foil 9 are glued to it.

The thus obtained ski has a length of 1.9 m, and, in the midpoint a width of 68 mm and a thickness 16.5 mm and a weight of 2.2 kg. The unloaded ski normally rests in two linear zones on the ground: a transverse touchdown line A near the upwardly arched ski tip and a transverse touchdown line B near the transverse rear edge of the ski. Its damping behaviour was tested as follows: the rear portion of the ski was fixed in a clamp and its free end was subjected to a single bending load applied perpendicularly to the ski plane so that the latter deflected in the point of loading through an amplitude of 5 cm. Upon releasing the thus loaded ski tip, the decaying vibration (back to its position of rest) was registered by a recorder. The vibration pickup is located 15 cm to the rear of the touchdown point A of the ski and the clamp is 9 cm behind the midpoint of the ski (towards its rear side).

The logarithmic decrement $$d = \ln \frac{a_o}{a_1} = \frac{1}{n-1} \ln \frac{a_o}{a_n}$$

and the damping rate $\delta = d/\eta(\%)$ were derived from the recorded vibration curve. For a homogeneous material the ratio of the successive vibration amplitudes $a_p/a_{p+1}$ $(o<p<n-1)$ is a constant. However, since the ski according to the invention has a heterogeneous buildup, d and $\delta$ will decrease according as the vibration dies away (disappears). In our case the damping rate and the logarithmic decrement were determined during the first second of the decaying vibration amplitude and compared with corresponding values of some commercially available skis that were tested in the same manner. For the ski according to the invention we found that $\delta=4\%$, whereas for some known skis lower values were recorded: $\delta=2.6\%$ ; $\delta=2.8\%$ ; $\delta=1.77\%$. According to this test only wooden skis show higher damping rates $\delta=5\%$. This proves that the damping behaviour of the ski according to the invention is already quite close to that of wooden skis. It is widely known that wooden skis show a better damping behaviour than conventional skis with glass-fibre reinforcements or metal honeycomb cores.

Another important damping parameter for skis is the speed at which the vibration dies away (the so-called decay rate) - $D=8.68C$ (dB/sec) where $$C = \ln \frac{V_o a_o}{a_s},$$

depending on d and on the natural frequency $$v_o = \frac{1}{2\eta} \sqrt{\frac{k}{m}}$$

where m is the mass and k the spring constant of the ski.

The vibration amplitudes $a_o$ and $a_s$ hereby refer to the values measured at the start of the vibration ($a_o$), respectively after a period of 1 second ($a_s$). For the ski according to the invention an average value for d is found of 29 dB/sec which already is quite high. It is evident that this value can be further raised by increasing the rigidity of the ski for substantially the same mass. The natural frequency is then increased by making the light core layer slightly thicker. Hence, according to the invention, it is possible to make skis of synthetic material with improved damping properties and with higher strengths without that the dimensions or weights of these conventional skis need to be changed. Therefore, the buildup of the ski is relatively simple. If the rubberlike layer contains a vulcanizable rubber, the metal strips can be directly bonded to this layer during the ski construction. The fact that the steel edges are bonded to the rubberlike material preferably over their whole length, provides a sort of floating arrangement which absorbs and dissipates shock waves from the tip or tail and hence improves the high speed control of the ski. The rubberlike layer at the underside may possibly be so composed that it possesses sufficient sliding properties to be used as runner surface for the ski.

Figure 2:
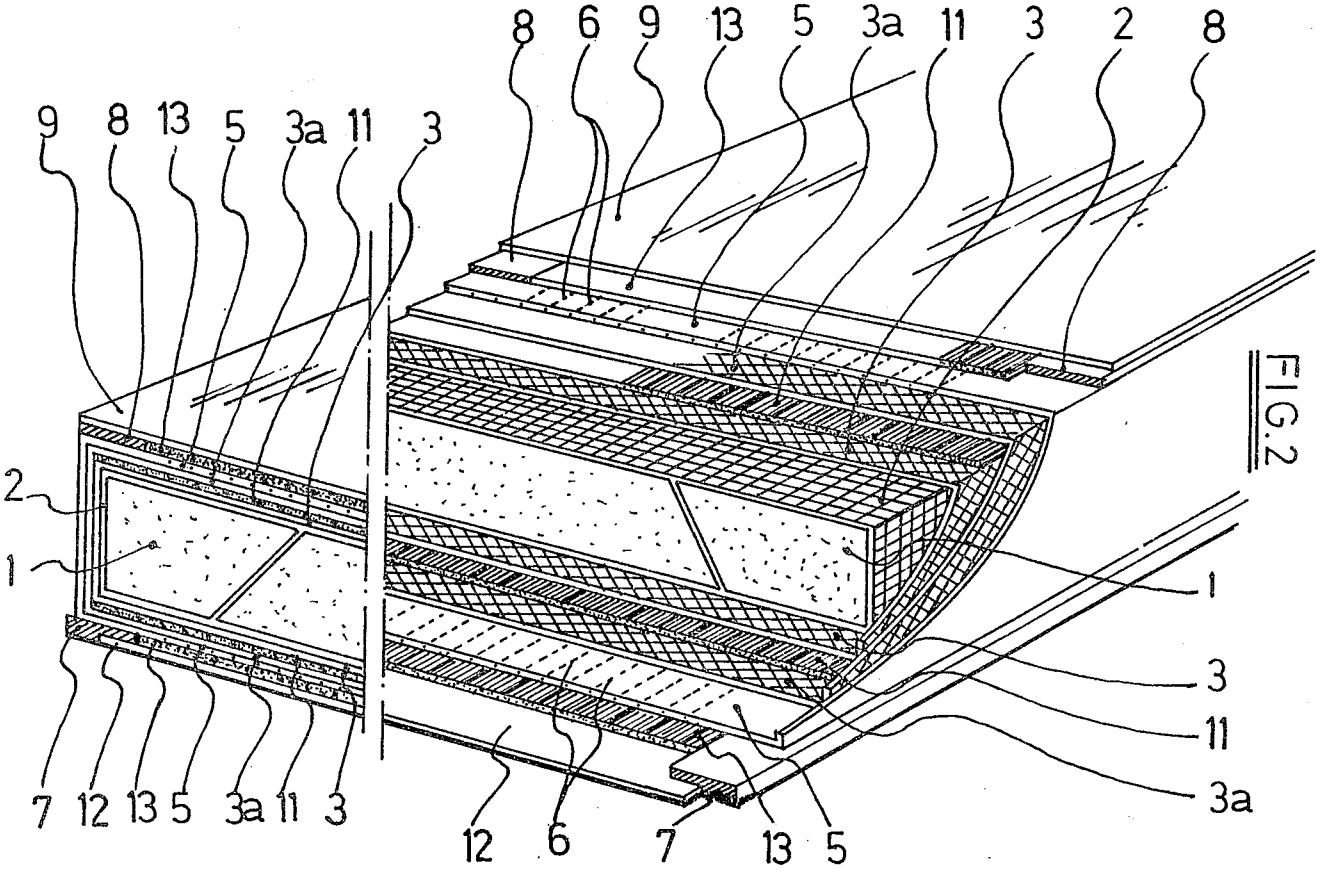
FIG. 2 is a cross-sectional view of a ski buildup whereby the rigid core layer is encased by rubberlike material.

The ski illustrated in FIG. 2 is built up as follows:

A core layer 1 of light and rigid material, so as for example balsa wood, plastic foam (for example from polyurethanes or polyacrylic acids) or a honeycomb structure (aluminium) is cut to dimensions and to the appropriate shape i.e. close to that of the final ski. This core layer is encased by a fabric 2 and then 3 from glass fibres impregnated with thermo-hardening resin. The warp (or the weft) of the fabric 2 extends in the longitudinal direction of the ski whereas that of the fabric 3 forms an angle of about 45° to the longitudinal direction of the ski. Subsequently, longitudinal layers 11 of resin-impregnated glass filaments are applied on the plane faces of the core structure (1, 2, 3) and this structure is encased by another sheet **3*a* of impregnated glass fabric. The layer 3 and 3*a* particularly increase the torsion resistance of the ski. This laminate structure of the core (1, 2, 3, 11, 3*a***) is placed in a suitable mould and heated to harden the resin.

Now this solidified structure (**1, 2, 3, 11, 3*a*) is enveloped in an unvulcanized rubber layer 5 with a thickness of about 0.75 mm and which comprises two series of 40 steel cords 6** of the 5×0.175 construction (5 torsioned 0.175 dia. wires) with an elongation at rupture of about 1.5%, one series being placed under the solidified structure and the other over it, each through a width of about 50 mm.

Hence, the lateral sides of the solidified structure are also covered by rubber. By this manufacturing method the subsequent treatment of glueing the lateral edges to the ski and straightening these edges are eliminated; the manufacture is thus made more simple.

After that, the two cutting steel edges 7 are placed in a second mould and between these edges a rigid plate 13 is provided, for example made of resin reinforced with glass filaments oriented in the longitudinal direction of the ski. On that, the core structure is placed which is encased by rubber and covered with the aluminium top edges 8 and with another rigid layer 13. The mould is then closed and heated to a temperature of approximately 150° C. for 15 minutes in order to vulcanize the rubber and to bond and consolidate all layers. Evidently it would be useful to apply appropriate adhesives (primers) between the layers 13 and 5, for example by applying such an adhesive to one of the layers.

Finally, to the upper surface of the ski body thus obtained a finishing sheet 9 is glued, for example on the basis of acrylonitrile polymer - butadene - styrene, and to the underside another layer 12 is glued, for example of polyoxymethylene.

On the spot where the shoes must be attached, an appropriate reinforcing plate is usually inserted in the structure, for example made of aluminium and having a thickness of 0.5 mm.

It is evident that sliding agents may be added to the rubberlike material.

The measures according to the invention are not limited to snow-skis; the good damping properties, combined with a high breaking strength, can also be favourably applied to other skis such as water skis and to runner surfaces for, say, speedboats, helicopters, ski-bobs, and snow sleighs with caterpillar drive (snowmobiles).

It is also possible to obtain an analogous damping effect by applying the fibres in such a way into the rubberlike layer that they are not predominantly tensile or compression loaded, but shear or torsion loaded. Also rubberlike strips with embedded fibres can be applied on the side-edges of the ski.

It is believed that the incorporation of the fibres in twisted bundle form surprisingly enhances the damping capacity of the ski structure. The fiber bundles e.g. steelcords should preferably present an elongation at rupture of between about 1.5% and 8%. In this way the spiralled filaments in the twisted bundle absorb energy when loaded either under axial compression or tension. Also the elastic deformation of the surrounding rubberlike material, which penetrates the bundle structure, adds to the damping capacity of the ski.

Further the twisted bundles in the rubberlike layers do not hinder the attachment of the clamps to the ski-lath for fixing the ski shoes on the skis.

I claim:

1. A longitudinally extending ski of the laminated type comprising an elongated core of rigid material, a top external surface, a bottom skiing surface, and a layer of rubberlike material disposed in interbonding relationship between said core and at least one of said surfaces, said rubberlike material having a loss tangent of about 0.1 and having longitudinally extending twisted filament bundles embedded therein, the filaments having a tensile strength of at least 2000 $N/mm^2$ and a modulus of elasticity of at least $7\times10^4$ $N/mm^2$.

2. A ski according to claim 1 wherein said core of rigid material has a density lower than 1000 $g/dm^3$.

3. A ski according to claim 1 wherein said rubberlike material comprises a thermoplastic resin.

4. A ski according to claim 1 wherein said rubberlike material comprises a thermoplastic elastomer.

5. A ski according to claim 1 wherein said rubberlike material comprises a vulcanized elastomer.

6. A ski according to claim 1 wherein said twisted filament bundles are embedded with an elongation at rupture of between about 1.5% and 8%.

7. A ski according to claim 1 wherein said embedded filament bundles comprise steel cords oriented in the longitudinal direction of the ski.

8. A ski according to claim 1 wherein between said rubberlike material and said core of rigid material an anchoring layer is applied.

9. A ski according to claim 1 wherein said core of rigid material is encased by the rubberlike material containing the embedded filament bundles.

10. A ski according to claim 9 wherein said embedded filament bundles extend only through a portion of at least one plane side of said ski.

* * * * *